United States Patent [19]

Mathis

[11] 4,023,732

[45] May 17, 1977

[54] ELEVATOR RAIL CLAMP

[76] Inventor: Edmond J. Mathis, c/o Asheville Elevator Co., Inc., P.O. Box 5863, Asheville, N.C. 28803

[22] Filed: Mar. 3, 1975

[21] Appl. No.: 554,720

[52] U.S. Cl. ..... 238/338; 238/310

[51] Int. Cl.[2] ..... E10B 9/00

[58] Field of Search ..... 52/758 C; 238/310, 314, 238/338, 342, 347, 349, 360, 361, 362, 364, 377, 378; 248/25, 226 R, 300, 500, 503, 507–510; 151/68

[56] References Cited

UNITED STATES PATENTS

| | | | |
|---|---|---|---|
| 764,362 | 7/1904 | Knox | 238/338 |
| 928,276 | 7/1909 | Ogden | 238/314 |
| 1,026,807 | 5/1912 | Joyal | 238/338 X |
| 1,037,750 | 9/1912 | Friedman | 238/338 X |
| 1,505,808 | 8/1924 | Ross | 238/338 X |
| 1,545,182 | 7/1925 | Beck | 151/68 UX |
| 1,797,214 | 3/1931 | Mayer et al. | 248/68 R |
| 1,975,377 | 10/1934 | Sharp | 238/349 X |
| 2,132,572 | 10/1938 | Maney | 238/338 X |
| 2,481,983 | 9/1949 | Dell | 238/361 X |
| 2,761,642 | 9/1956 | Rachlin | 248/300 X |
| 3,206,123 | 9/1965 | Baker | 238/349 |
| 3,582,029 | 6/1971 | Moesia | 248/300 X |
| 3,653,591 | 4/1972 | Varga et al. | 238/377 X |
| 3,888,413 | 6/1975 | Molyneux | 238/349 |
| 3,904,113 | 9/1975 | Molyneux | 238/310 X |

FOREIGN PATENTS OR APPLICATIONS

| | | | |
|---|---|---|---|
| 847,661 | 7/1970 | Canada | 248/300 |
| 826,501 | 4/1938 | France | 238/338 |
| 570,369 | 2/1933 | Germany | 238/338 |
| 647,569 | 7/1937 | Germany | 238/338 |
| 956,760 | 1/1957 | Germany | 238/310 |

*Primary Examiner*—Lawrence J. Staab
*Attorney, Agent, or Firm*—John C. Blair

[57] ABSTRACT

A clamping device particularly suited for clamping the rails of an elevator to the frame of a building. Such elevator rails are usually T-shaped in section, having the base fastened to fastening elements or brackets on the frame and the vertical portion extending therefrom. Clamps are used to fasten the base of these rails to the brackets on the building. The clamp here described has a flat base with two spaced longitudinal flanges and a hole in the base for the reception of a bolt. The longitudinal flanges are partially cut out along their bottom edges and there is a lateral flange extending between them immediately behind the cut out portions. The cut out portions are shaped to fit on the base of the rail. The longitudinal flanges contact two flat sides of the head of a fastening bolt, which may be inserted in holes in the clamp and bracket. A nut on the bolt is tightened by the use of one wrench for the bolt is held from rotation.

3 Claims, 3 Drawing Figures

ELEVATOR RAIL CLAMP

BACKGROUND OF THE INVENTION

This invention relates to clamping devices particularly designed for, but not limited to, a clamp for holding an elevator rail securely against fastening elements or brackets on the frame of a building. The usual clamp used for this purpose is a stepped up plate with a hole to accommodate a bolt. Such clamps are inconvenient when tightening, because the clamp and head must be held while the nut is tightened. The clamping device of the invention comprises a base with spaced longitudinal side flanges and a hole for a bolt extending through both clamp and bracket with a nut on the far side. The flanges are dimensioned to fit against sides of the head of the bolt to hold it against rotation while the nut is tightened. Furthermore, the clamp has front cut out portions in the longitudinal flanges dimensioned to fit over the edge of the rail. There is a lateral flange between the longitudinal flanges which is angled to present a caming surface against the edge of the rail. Thus as the nut is tightened, the lateral flange cams on the edge of the rail base to form a tight fit. Use of these clamps saves considerable labor, because the bolt is fixed against rotation while the nut is tightened. Not only is this clamp much stronger than the old flat, stepped plate, because of the flanges, but it is convenient for the installer who merely tightens the nut with one hand and wrench. Obviously the bolts may be reversed with the nuts between the flanges.

An object of the present invention is to provide a clamping device for elevator rails or the like which may be easily installed to firmly secure such rails to a building.

Another object is to provide a device of the above character which may be economically manufactured and yet provide an unusually strong clamp capable of holding the rail to the building, no matter what upsetting forces are applied thereto during elevator operation.

Finally, it is an object of this invention to provide a device of the above character which may be easily installed in clamping position with great reduction in labor and resulting expense.

Other objects, advantages and salient features of the present invention will become apparent from the following detailed description, which, taken in conjunction with the annexed drawing, discloses a preferred embodiment thereof.

Referring now to the drawing, which forms a part of the original disclosure.

DETAILED DESCRIPTION OF A PREFERRED EMBODIMENT

Figure 1:
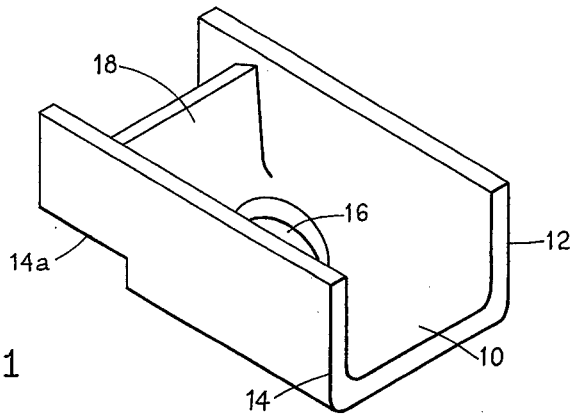
FIG. 1 is a perspective view of the clamp before installation.

Similar reference characters refer to similar parts throughout the several views of the drawing.

The clamp of the present invention is shown uninstalled in FIG. 1 and comprises a base 10 having two vertical longitudinal flanges 12 and 14 and a hole 16 in the base for accommodation of a bolt. The longitudinal flanges 12 and 14 have cut out portions, one of which is shown at **14*a* in FIG. 1, and there is a lateral flange 18 extending between the two longitudinal flanges 12 and 14** adjacent the rear of the cut out portions.

Figure 2:
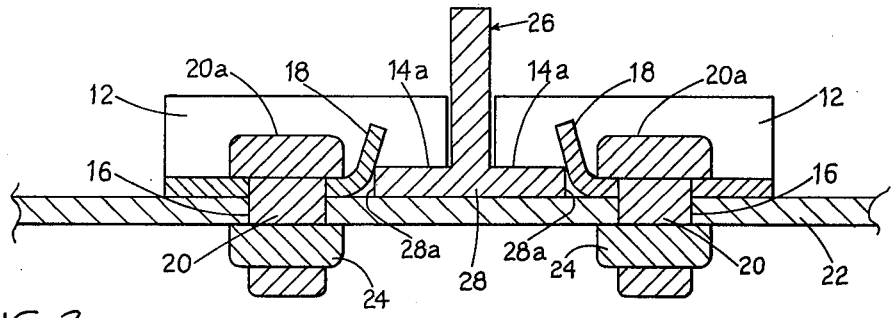
FIG. 2 is a vertical sectional view of two of the clamps installed and holding an elevator rail against a bracket or the like on the building and taken along the line 2—2 of FIG. 3
Figure 3:
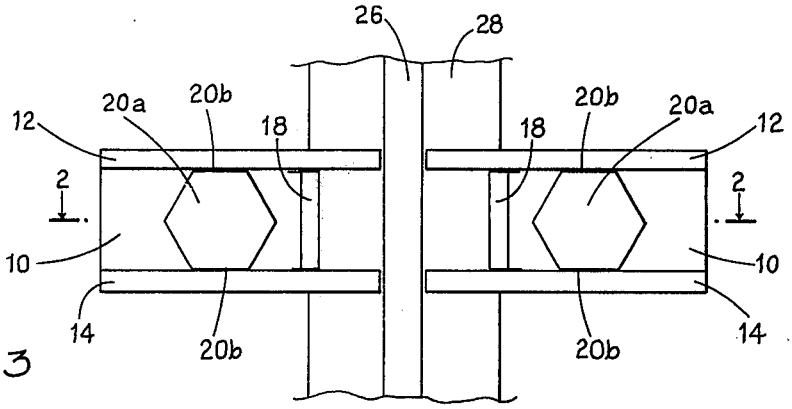
FIG. 3 is a top plan view of the clamps installed to hold the elevator rail as shown in FIG. 2.

Two of these identical clamps are shown in FIGS. 2 and 3 in clamped position with bolts 20 extending through holes 16, and through a bracket portion 22 attached to a building. Nuts 24 on the bolts 20 are tightened to hold the elevator rail generally indicated at 26 against the bracket portion 22.

As better seen in FIG. 3, the heads **20*a* of bolts 20 are surfaced and dimensioned so that flat sides 20*b* rest against the inner surfaces of flanges 12 and 14 which fix the bolts against rotation during nut tightening. As seen in FIG. 2 lateral flange 18 is angled to slant toward the edge 28*a* of the base 28 of elevator rail 26. Thus, when the nut 24 is tightened the flange 18 cams against the edge 28*a*** to form a firm, tight fit between rail, clamp and bracket portion.

It will now be seen that the clamp of this invention is ideally designed to be conveniently installed to clamp the base 28 of an elevator rail 26 to a building. Preferably, as shown in FIGS. 2 and 3, two of the clamps are placed against the elevator rail with the cut out portions **14*a* resting on top of the base 28 of the rail (FIG. 2). In the position the lateral flanges 18 rest against the edge 28*a* of the base of the rail and bolt 20 extends through the clamp and bracket 22**.

Finally nuts 24 may be easily tightened on the bolt, and, as tightened, the lateral flange 18 cams against the edge **28*a* of the elevator rail to form a tight grip therewith, while the bolt is held against rotation. The clamps of this invention can be installed with a maximum of convenience for when the bolts are inserted as shown in FIGS. 2 and 3**, it is only necessary to tighten the nuts with one hand to fix them in permanent position.

The clamp of this invention is first very strong in resisting any bending action due to the reinforcing action of flanges 12 and 14. The clamp is also designed to provide a firm fastening fit with the base 28 of the rail because of the caming action of lateral flange 18. Finally, and perhaps most important these clamps may be installed simply by inserting the bolt and the nut with one hand.

It will thus be apparent that the invention set forth herein describes a new, unique and useful clamp which accomplishes the objects set forth hereinabove. However, since the foregoing detailed description as directed only to a perferred embodiment of the invention, various changes and modifications apparent to those skilled in the art, can be made without departing from the spirit and scope of the invention.

What is claimed:

1. Apparatus for clamping an elevator rail or the like to a building frame wherein the rail is substantially T-shaped in cross section with a horizontal section and a vertical section, the combination of a clamp having a base having two spaced longitudinal flanges extending substantially vertically therefrom, said flanges extending beyond said base to form cut-out portions with bottom horizontal edges adapted to fit over the top of said horizontal section of said rail, the inner end portion of said cut-out portion adapted to fit against the edge of said rail, said base having a hole receiving a standard bolt which may extend therethrough and through a hole in said building frame, said standard bolt having a head with a plurality of flat surfaces the dimensions of said head and of the space between said longitudinal flanges being such that two of said surfaces substantially engage the inside surfaces of said longitudinal flanges when the bolt is inserted in the clamp, whereby said bolt is held against rotation in said clamp when a nut is screwed thereon and said clamp is held against rotation by the edge of said rail during tightening.

2. The combination according to claim 1 and further wherein there is a lateral flange extending between said longitudinal flanges at the inner end of said cut-out portion and shaped and dimensioned to fit against the edge of said horizontal section of said rail when said clamp is bolted to said building frame.

3. The combination according to claim 2 wherein said lateral flange is at an angle to the vertical to provide a caming surface against the edge of said horizontal section whereby said clamp is bolted down and tightened against said building frame said lateral flange cams against said edge of said rail to form a firm fit therewith.

* * * * *